US005611203A

United States Patent [19]

Henderson et al.

[11] Patent Number: 5,611,203

[45] Date of Patent: Mar. 18, 1997

[54] EJECTOR PUMP ENHANCED HIGH PRESSURE EGR SYSTEM

[75] Inventors: Gregory H. Henderson; Van Sudhakar, both of Columbus, Ind.

[73] Assignee: Cummins Engine Company, Inc.

[21] Appl. No.: 544,148

[22] Filed: Oct. 17, 1995

Related U.S. Application Data

[62] Division of Ser. No. 354,622, Dec. 12, 1994, abandoned.

[51] Int. Cl.[6] ..... F02M 25/07

[52] U.S. Cl. ..... 60/605.2

[58] Field of Search ..... 60/605.2; 123/568; 417/198

[56] References Cited

U.S. PATENT DOCUMENTS

| | | | |
|---|---|---|---|
| 2,270,546 | 1/1942 | Neuland | 417/198 |
| 2,297,910 | 10/1942 | Neuland | 417/198 |
| 3,996,748 | 12/1976 | Melchior | 60/605.2 |
| 4,196,706 | 4/1980 | Kohama et al. . | |
| 4,217,869 | 8/1980 | Masaki . | |
| 4,276,865 | 7/1981 | Hamai . | |
| 4,426,848 | 1/1984 | Stachowicz | 60/605.2 |
| 5,333,456 | 8/1994 | Bollinger | 60/605.2 |
| 5,425,239 | 6/1995 | Gobert | 60/605.2 |

FOREIGN PATENT DOCUMENTS

| | | | |
|---|---|---|---|
| 4-47157 | 2/1992 | Japan | 60/605.2 |
| 422861 | 4/1974 | U.S.S.R. | 60/605.2 |

OTHER PUBLICATIONS

American Institute of Aeronautics and Astronautics, Paper No. AIAA-88-0188, Entitled Parameter Effects on Mixer-Ejector Pumping Performance, Stanley A. Skebe, Duane C. McCormick, Walter M. Presz, Jr.

*Primary Examiner*—Michael Koczo

*Attorney, Agent, or Firm*—Sixbey, Friedman, Leedom & Ferguson; Charles M. Leedom, Jr.; David S. Safran

[57] ABSTRACT

An exhaust gas recirculation system for an internal combustion engine by which a portion of exhaust gases produced by the engine is recirculated from an exhaust line of the engine into an intake line of the engine introduces the EGR exhaust gas flow into the intake passageway via a mixer ejector which is provided with mixer lobes and a diffuser downstream of the lobes. The mixer ejector enhances the momentum transfer from the intake flow to the exhaust flow, and in this way, the static pressure of the exhaust flow at the entrance to the mixing region is decreased, thereby increasing the differential pressure across the EGR tube and increasing the exhaust flow. In a second embodiment, in addition to, or instead of, using the special ejector construction of the first embodiment, an ejector pump is located in the EGR tube. The ejector in the EGR tube is connected to the vehicle air system compressor or turbocompressor and serves to pump the exhaust gases to the engine intake passageway. This embodiment enables a more precise controlling of the EGR rate to be obtained, and can provide more EGR flow that which could be obtained with an intake ejector or venturi alone.

8 Claims, 6 Drawing Sheets

EJECTOR PUMP ENHANCED HIGH PRESSURE EGR SYSTEM

This application is a divisional of Ser. No. 08/354,622, filed Dec. 12, 1994, now abandoned.

BACKGROUND OF THE INVENTION

1. Field of the Invention

The present invention relates to exhaust gas recirculation (EGR) systems for internal combustion engines. More specifically, the invention is directed to EGR systems of the type which recirculate at least a portion of the engine exhaust gases into the engine air intake system for the purpose of reducing NOx emissions.

2. Description of Related Art

With continued tightening of governmental regulations on vehicular exhaust emission, particularly NOx, not only has the need to recirculate exhaust gases back to the engine intake become apparent, but so has the need to improve upon existing EGR technology.

U.S. Pat. No. 4,217,869 to Masaki discloses an EGR system in which combustion gases are forced from a reaction chamber through an outlet port into an intake passageway by either an ejector effect or suction produced by the engine exhaust gases drawn from an outlet portion of an EGR passageway.

Likewise, commonly owned, co-pending U.S. patent application Ser. No. 08/152,453 discloses an exhaust gas recirculation system in which a venturi or ejector tube is used to create a pressure differential across the EGR tube to drive the exhaust gases into the engine intake passageway.

However, such systems, when used on engines having efficient turbomachinery and/or an EGR cooler, especially on heavy duty engines, face the problem that an exhaust-to-intake pressure differential can occur that is either too low or unfavorable. This is particularly the case at rated speed and high loads where EGR rates near 20% may be required, necessitating EGR flow rates beyond that which simple venturi or ejector aided induction systems can supply.

The deficiencies of pressure differential type EGR induction systems have been recognized for some time. In U.S. Pat. No. 4,196,706 to Kohama et al., control valves are used to regulate the quantity of exhaust gas that is recirculated, and in recognition of the fact that insufficient ERG pressure may exist under certain operating conditions, Hamai U.S. Pat. No. 4,276,865 teaches the use of an engine-driven pump upstream of the EGR control valve for insuring that sufficient pressure exists to introduce the EGR gases into the engine intake passageway. However, the use of an engine-driven pump adds to the cost and weight of the EGR system, and is a source of parasitic losses.

Thus, the need still exists for a simple and inexpensive means for insuring that sufficient pressure exists to introduce the EGR gases into the engine intake passageway under all conditions, and particularly on turbocharged diesel engines.

As described in an article entitled "Parameter Effects on Mixer-Ejector Pumping Performance" (Skebe et al., AIAA-88-0188, American Institute of Aeronautics and Astronautics, 1988) ejectors have been used to improve aircraft performance in a variety of ways, including engine component cooling, thrust augmentation, and exhaust noise and temperature reduction. In this context, and particularly for advanced turbofan applications, a substantial increase in pumping performance of an ejector system has been found to be obtainable through the use of low loss "forced" mixer lobes. However, such lobed mixer type ejectors have not been used in land vehicle applications, especially with land vehicle engines, such as diesel engines, and particularly not in connection with EGR systems for such engines, either with or without exhaust driven turbocompressors.

SUMMARY OF THE INVENTION

In view of the foregoing, it is a primary object of the present invention to provide an exhaust gas recirculation (EGR) system in which sufficient pressure exists to introduce the EGR gases into the engine intake passageway under all conditions.

In keeping with the foregoing object, it is an associated object of the present invention to enable EGR to be effectively utilized on an engine having a supercharger or turbocharger.

It is a more specific object of the present invention to achieve the above objects through the use of an improved construction for an EGR ejector tube that is designed to increase the flow of exhaust gas.

Another specific object of the present invention to achieve the above objects by providing a means for introducing high pressure air into the EGR tube to increase the flow of exhaust gas.

These and other objects are achieved by preferred embodiments of the present invention. More specifically, in accordance with a first embodiment of the invention, an ejector which is provided with mixer lobes and a diffuser which enhances the momentum transfer from the intake flow to the exhaust flow is utilized to introduce the EGR exhaust gas flow into the intake passageway. In this way, the static pressure of the exhaust flow at the entrance to the mixing region is decreased, thereby increasing the differential pressure across the EGR tube and increasing the exhaust flow.

As an alternative approach, in addition to, or instead of, using the special ejector construction of the first embodiment, an ejector pump is located in the EGR tube. The ejector in the EGR tube is connected to the vehicle air system compressor or turbocompressor and serves to pump the exhaust gases to the engine intake passageway. This embodiment enables a more precise controlling of the EGR rate to be obtained, and can provide more EGR flow that which could be obtained with an intake ejector or venturi alone.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
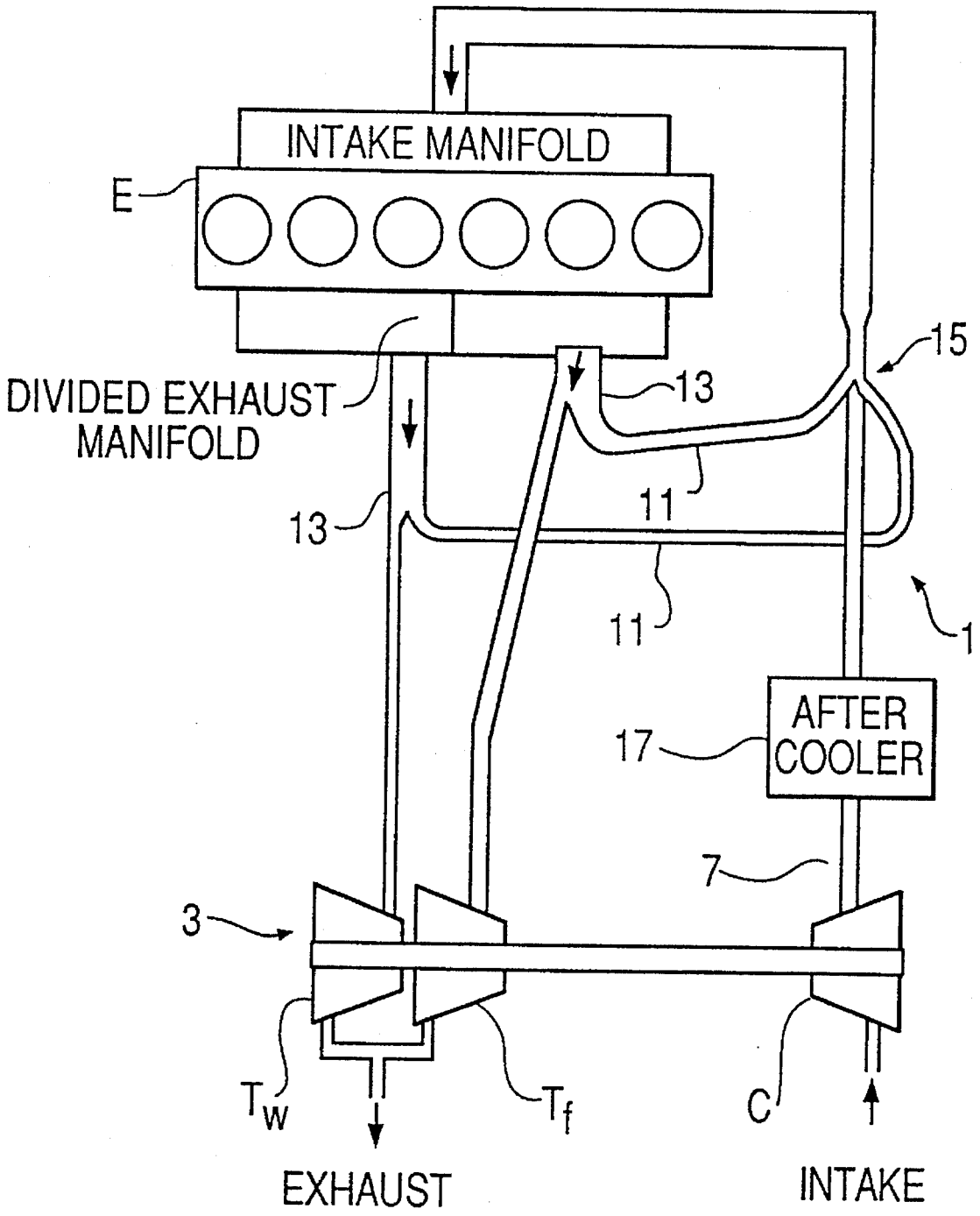
FIG. 1 is a schematic depiction of an EGR system in accordance with a first embodiment of the present invention.

FIG. 1 schematically represents an EGR system 1, in accordance with a first embodiment of the present invention, in which exhaust gases produced by an engine E are directed to a twin entry turbocharger 3 which can be provided with a waste-gated turbine $T_w$ and a fixed geometry turbine $T_f$. In this way, exhaust energy acting on the turbines drives a compressor C to boost air intake pressure in air intake line 7 which delivers combustion air to the engine E. After passing through the turbocharger 3, the exhaust gases can be passed through a passive or catalyzed particulate trap (not shown). An EGR line 11 branches off of each exhaust line 13 upstream of the turbocharger 3 and exhaust gases are drawn into this line at charge pressure via an ejector 15 (described in greater detail below relative to FIG. 2) that is disposed in the intake line 7 downstream of an air-to-air aftercooler 17.

Figure 2:
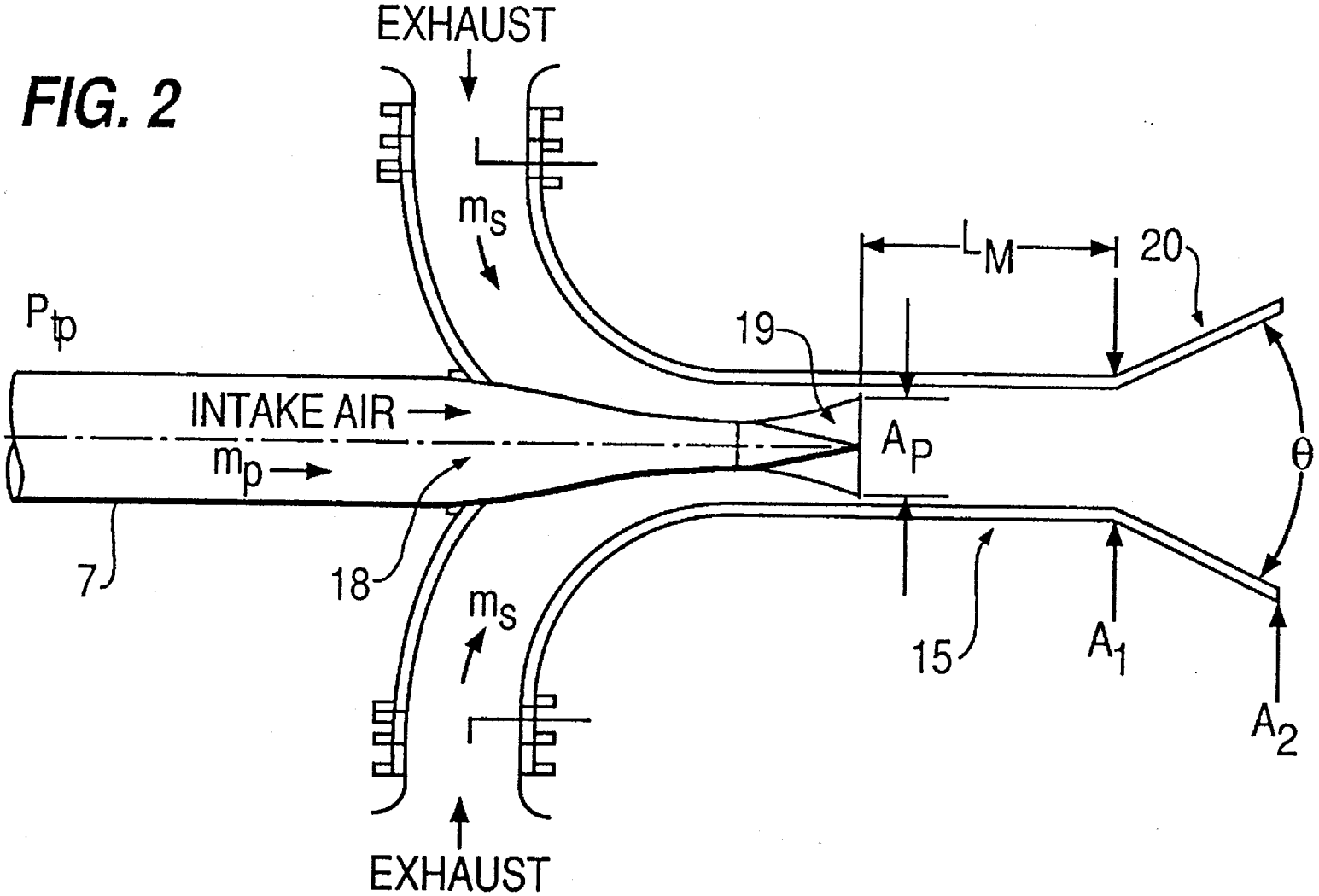
FIG. 2 is a cross-sectional view of the ejector arrangement of the FIG. 1 embodiment.
Figure 4A:
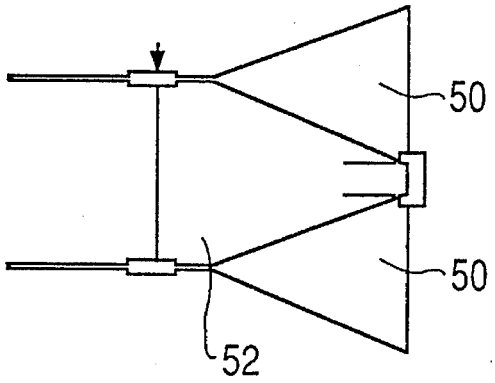
FIG. 4A (PRIOR ART)
FIG. 4A is a side view of a first embodiment of a prior art lobed mixer of the type used in the present invention.
Figure 4B:
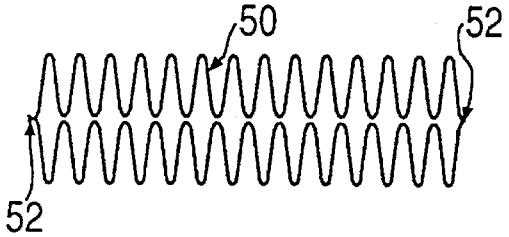
FIG. 4B (PRIOR ART)
FIG. 4B is an exit view of the prior art lobed mixer of FIG. 4A.
Figure 5A:
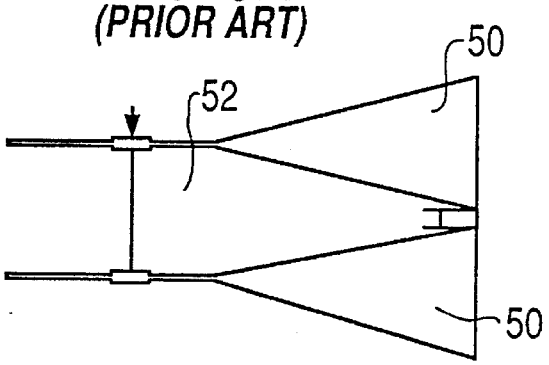
FIG. 5A (PRIOR ART)
FIG. 5A is a side view of a second embodiment of a prior art lobed mixer of the type used in the present invention.
Figure 5B:
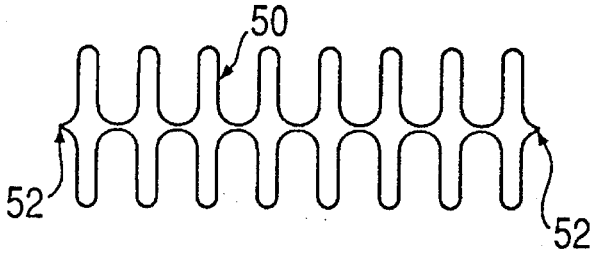
FIG. 5B (PRIOR ART)
FIG. 5B is an exit view of the prior art lobed mixer of FIG. 5A.

The ejector 15 is of the lobed mixer type ejector shown in FIGS. 4A, 4B and 5A, 5B. This ejector is of a known type (see above-mentioned Skebe et al. article) which has two identical lobe surfaces. The ends of the lobed surface 50 are attached to side plates 52 to establish the correct relative angles. Side plates 52 and metal spacers (not shown) maintain proper separation distance. The leading edges of the assembled lobed ejector are attached at the exit plane of the transition duct 18 by aluminum strips (not shown) riveted to the lobe surface 50 being attached to upper and lower surfaces of the transition duct. With reference to FIG. 2, it can be seen that a primary flow of intake air in the intake passageway 7 converges with a secondary flow of exhaust from the exhaust lines 11 in a transition duct 18 which has a three dimensional lobed mixer 19. Lobed mixer 19, when viewed on end looking in an upstream direction has the appearance of rakes positioned back-to-back with their tines oriented vertically, as seen in FIGS. 4B and 5B. In the cross-section shown in FIG. 4B, the ejector's lobe surface is a sine-wave, while the ejector cross-section shown in FIG. 5B is formed of non-uniformly spaced circular arcs. The primary flow of intake air and the secondary flow of exhaust pass over opposite sides of the lobed mixer 19 and are caused to rapidly mix within a mixing duct section having a rectangular cross section of area $A_1$ and length $L_M$. The mixed flows then pass through a diffusor section 20 having an exit area $A_2$, and an angle of divergence θ. With such a mixer type ejector, neither the ratio of the length $L_M$ to the height of the rectangular mixing duct section nor the extent that the primary flow total pressure $P_{tp}$ exceeds atmospheric pressure is of any significant effect, while the pumping ratio, i.e., the ratio of the mass flow rates $m_s/m_p$, is directly linearly proportional to increases in the ratio between the primary flow exit area $A_p$ of the lobed mixer 19 and the secondary flow exit area therefrom, $A_s$, i.e., $A_{s/Ap}$, (with efficiencies in excess of 1 being obtainable), $A_s$. being equal to the difference between $A_1$ and $A_p$ for values of $A_{s/Ap}$ up to around 3. The exit area $A_2$, and the angle of divergence θ will normally be determined empirically for a specific application.

Because of the high pumping efficiency obtainable with the lobed mixer type ejector 15, it is possible for appropriate EGR rates to be generated (about four times that obtainable using a venturi) with a minimal performance penalty to the engine together and high reliability (in comparison to an engine driven pump as used, for example, in the Hamai patent noted above in the Background section) due to the absence of moving parts. Furthermore, since the ejector works by enhancing momentum transfer from the primary air flow to decrease the static pressure of the exhaust flow, it is less primary air pressure sensitive than a venturi, and thus is better able to overcome the additional pressure losses and unfavorable pressure gradients associated with the use of an EGR cooler and/or efficient turbomachinery on heavy duty diesel engines.

Figure 3:
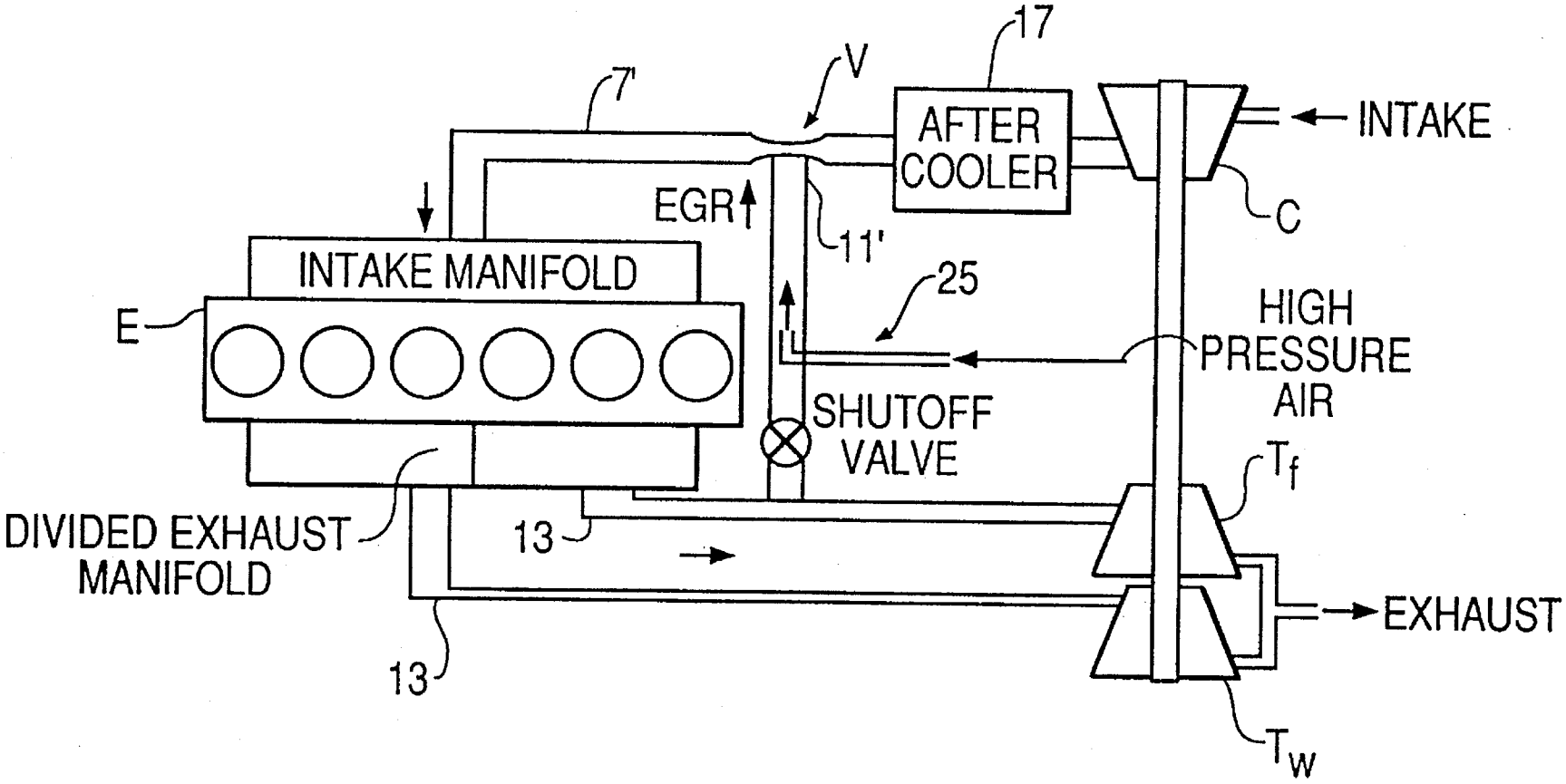
FIG. 3 is a schematic depiction of an EGR system in accordance with a second embodiment of the present invention.
Figure 6:
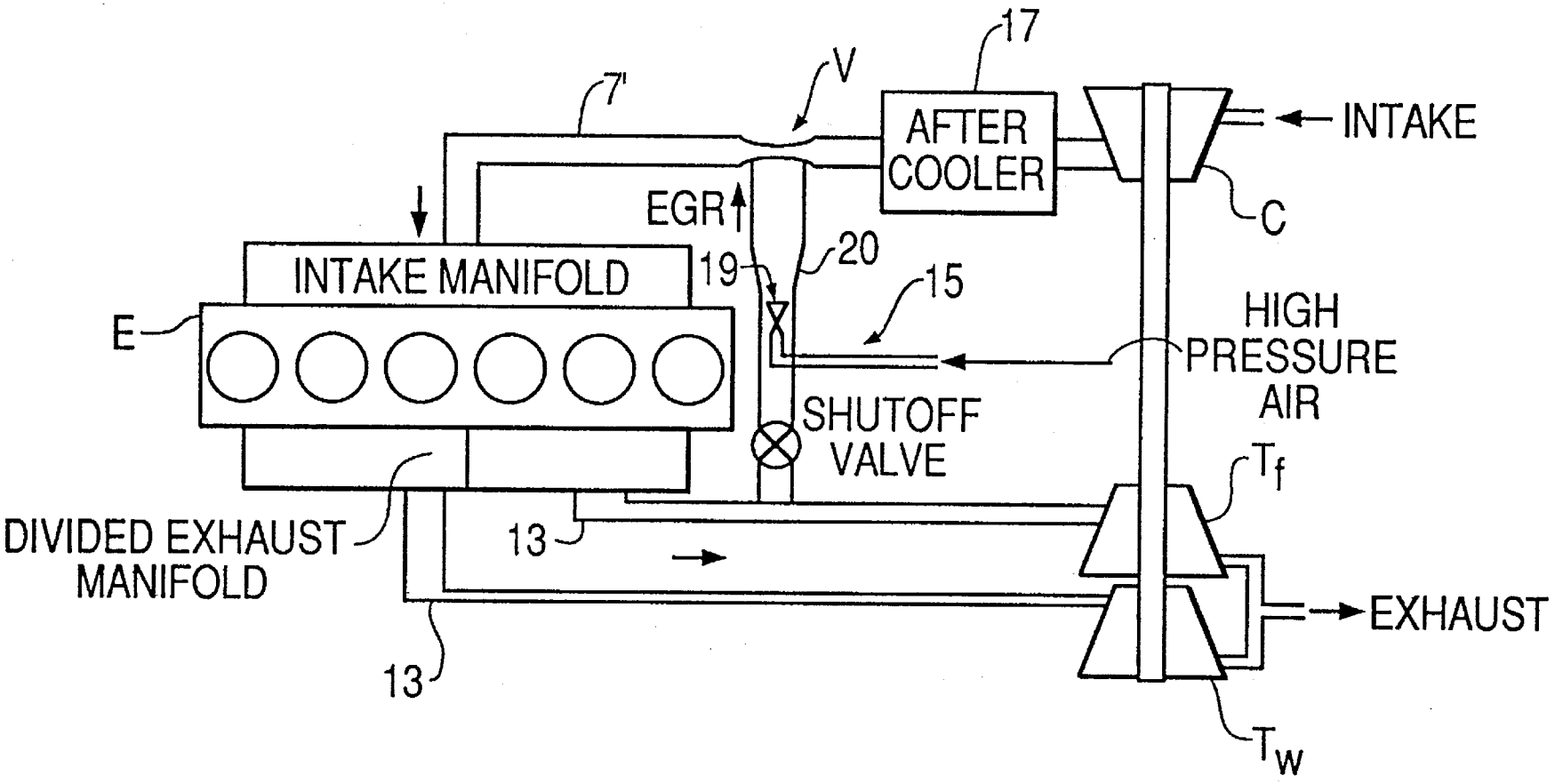
FIG. 6 is a view corresponding to that of FIG. 3, showing a first modification thereto.
Figure 7:
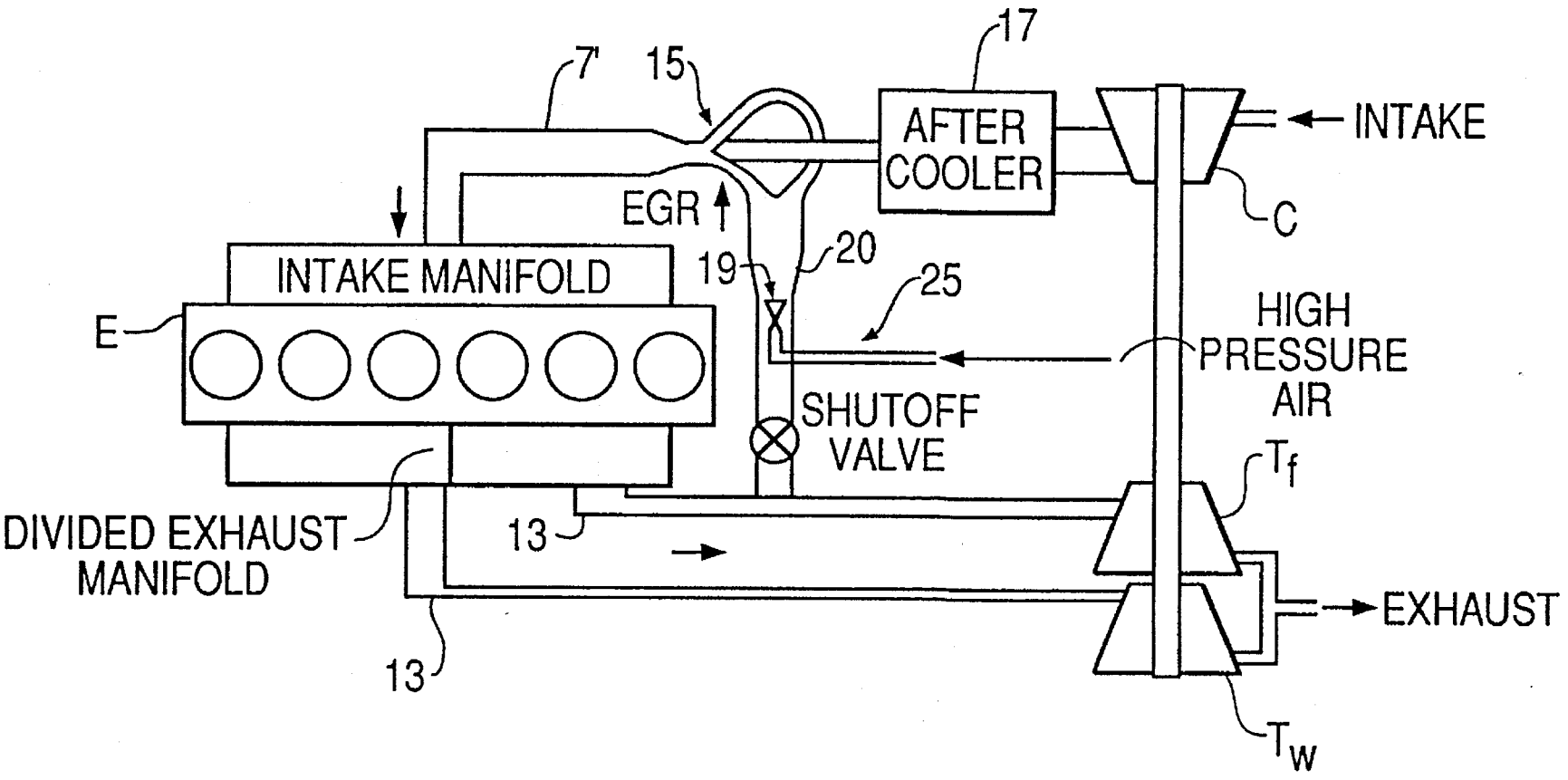
FIG. 7 is a view corresponding to that of FIG. 3, showing a second modification thereto.

In the embodiment of FIG. 3, an ejector 25 is provided which is connected to a source of high pressure air, such as that from compressor C, or a separate turbocompressor, and acts to entrain the exhaust gases and pump them to the engine intake passageway 7'. The ejector 25 can be, like ejector 15, of the lobed mixer type shown in FIG. 2 (as shown in FIGS. 6 & 7) or it can be a simple pipe type ejector. Likewise, the EGR line 11' can be connected to the intake passageway 7' via a venturi V, as shown, or via an ejector that also can be either a lobed mixer type ejector (FIG. 7) or a simple pipe type ejector.

With this arrangement, a precise control of the EGR rate can be obtained because the ejector/venturi performance and differential pressure between the manifolds will have a relatively lower order significance, and thus, controlling of the pressure of the high pressure air input will control the EGR flow. Additionally, a higher EGR flow can be obtained with this arrangement than can be obtained with an ejector or venturi connection between the EGR line 11, 11' and intake passageway 7, 7' alone.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

Industrial Applicability

The present invention will find applicability for use on a wide range of engine types for purposes of meeting stringent emissions regulations, particularly those applicable to vehicular turbo-equipped diesel engines.

We claim:

1. An exhaust gas recirculation system for an internal combustion engine by which a portion of exhaust gases produced by the engine is recirculated from an exhaust line of the engine into an intake line of the engine, said exhaust gas recirculation system comprising an exhaust gas recirculation line connecting the exhaust line of the engine to the intake line of the engine, a pressure differential means for drawing a secondary flow from said recirculation line into a primary flow in said intake line, and an ejector connected to a source of high pressure air, said ejector having a discharge end disposed in said recirculation line.

2. An exhaust gas recirculation system according to claim 1, wherein said pressure differential means comprises a venturi in said intake line.

3. An exhaust gas recirculation system according to claim 2, wherein said ejector is a lobed mixer type ejector which mixes exhaust gas in said exhaust gas recirculation line with air from said source of high pressure air upstream of a diffuser section of the exhaust gas recirculation line.

4. An exhaust gas recirculation system according to claim 1, wherein said pressure differential means comprises a second ejector, said second ejector extending into said intake line.

5. An exhaust gas recirculation system according to claim 4, wherein said second ejector is a lobed mixer type ejector which mixes said secondary flow from said exhaust gas recirculation line with said primary flow in a portion of said intake line located upstream of a diffuser section of the intake line.

6. An exhaust gas recirculation system according to claim 1, wherein said ejector is a lobed mixer type ejector which mixes exhaust gas in said exhaust gas recirculation line with air from said source of high pressure air upstream of a diffuser section of the exhaust gas recirculation line.

7. An exhaust gas recirculation system according to claim 6, wherein said source of high pressure air is a compressor of an exhaust gas powered turbocharger having at least one turbine, said exhaust line being connected to said at least one turbine downstream of said exhaust gas recirculation line, and said exhaust gas recirculation line being connected to the intake line downstream of said compressor.

8. An exhaust gas recirculation system according to claim 1, wherein said source of high pressure air is a compressor of an exhaust gas powered turbocharger having at least one turbine, said exhaust line being connected to said at least one turbine downstream of said exhaust gas recirculation line, and said exhaust gas recirculation line being connected to the intake line downstream of said compressor.

* * * * *